US007175547B2

(12) United States Patent
Naus, Jr.

(10) Patent No.: US 7,175,547 B2
(45) Date of Patent: Feb. 13, 2007

(54) TEEING DEVICE AND METHOD OF OPERATING THEREOF

(76) Inventor: Barry Naus, Jr., 1034 Oley St., Reading, PA (US) 19604

( * ) Notice: Subject to any disclaimer, the term of this patent is extended or adjusted under 35 U.S.C. 154(b) by 0 days.

(21) Appl. No.: 10/908,366

(22) Filed: May 9, 2005

(65) Prior Publication Data

US 2005/0255929 A1 Nov. 17, 2005

Related U.S. Application Data

(60) Provisional application No. 60/570,491, filed on May 13, 2004.

(51) Int. Cl.
*A63B 57/00* (2006.01)

(52) U.S. Cl. ..... 473/386

(58) Field of Classification Search ..... 473/386, 473/132, 137; 294/19.1, 19.2
See application file for complete search history.

(56) References Cited

U.S. PATENT DOCUMENTS

| | | | | |
|---|---|---|---|---|
| 1,863,140 | A | 6/1932 | Mulvaney | |
| 2,609,198 | A | 9/1952 | Armstrong | |
| 4,360,199 | A * | 11/1982 | Jackson | 473/386 |
| 4,616,826 | A | 10/1986 | Trefts | |
| 4,819,938 | A | 4/1989 | Hill | |
| 4,949,961 | A | 8/1990 | Milano | |
| 4,969,646 | A | 11/1990 | Tobias | |
| 5,080,357 | A | 1/1992 | Wolf | |
| 5,310,177 | A | 5/1994 | Conrad et al. | |
| 5,330,178 | A | 7/1994 | Geishert, Sr. | |
| 5,407,194 | A | 4/1995 | Snow | |
| 5,439,213 | A | 8/1995 | Pimentel | |
| 5,499,813 | A | 3/1996 | Black | |
| 5,624,333 | A * | 4/1997 | Dayton | 473/386 |
| 5,632,696 | A | 5/1997 | Nichols et al. | |
| 5,669,646 | A | 9/1997 | Fiocca et al. | |
| 5,672,121 | A | 9/1997 | Miller | |
| 5,707,303 | A | 1/1998 | Berkowitz et al. | |
| 5,759,117 | A | 6/1998 | Erickson, Jr. | |
| 5,928,091 | A | 7/1999 | Corriveau | |
| 6,053,821 | A | 4/2000 | Palmer | |
| D426,856 | S | 6/2000 | Engel | |
| 6,203,452 | B1 * | 3/2001 | Kelman et al. | 473/386 |
| 6,254,497 | B1 | 7/2001 | Brant et al. | |
| D460,797 | S | 7/2002 | Raeburn et al. | |
| 6,461,254 | B1 | 10/2002 | Ballett et al. | |

* cited by examiner

*Primary Examiner*—Steven Wong
(74) *Attorney, Agent, or Firm*—Connolly Bove Lodge & Hutz LLP

(57) ABSTRACT

A teeing device includes a ball magazine an actuator having a tee magazine, and a base connected to the ball magazine and the actuator by a common passage. Pressing the actuator downward places a tee and in the ground with a ball set on the tee.

13 Claims, 8 Drawing Sheets

TEEING DEVICE AND METHOD OF OPERATING THEREOF

BACKGROUND

Technical Field

The technical field relates to golf equipment for setting a tee in the ground with a ball set thereon.

BRIEF DESCRIPTION OF THE DRAWING FIGURES

DETAILED DESCRIPTION

Figure 1:
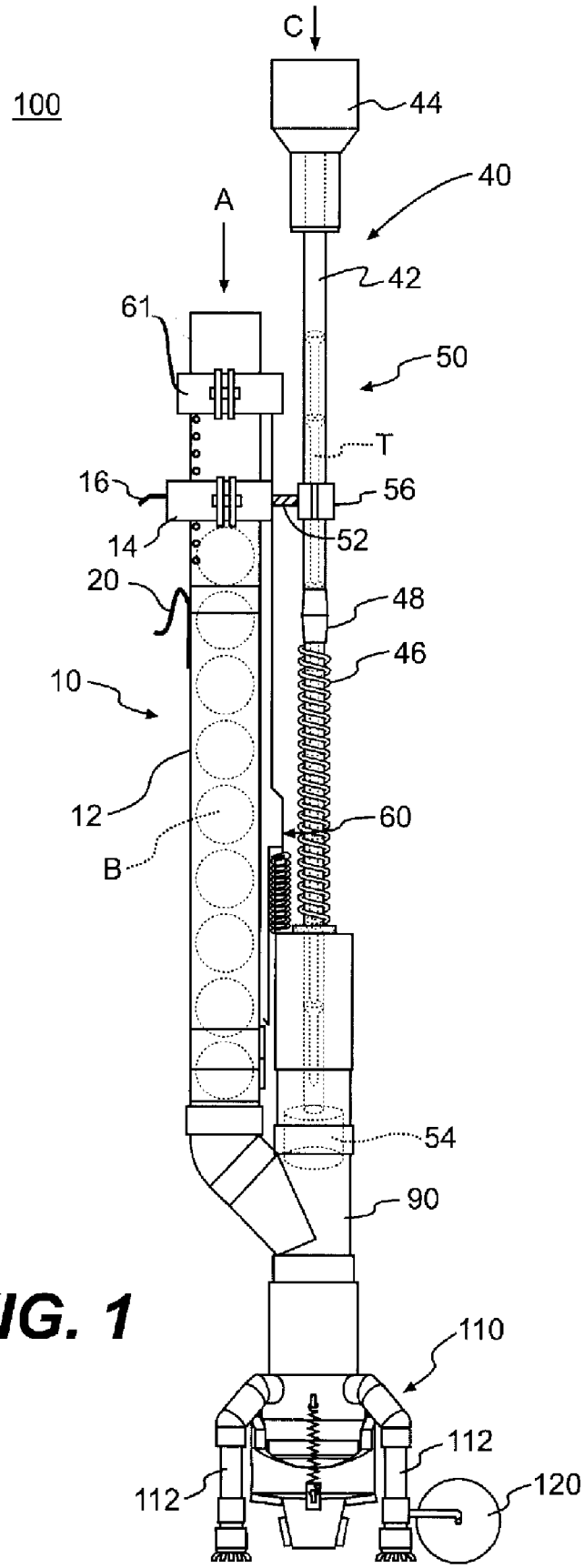
FIG. 1 is a front elevational view of a first embodiment of a teeing mechanism.
Figure 2:
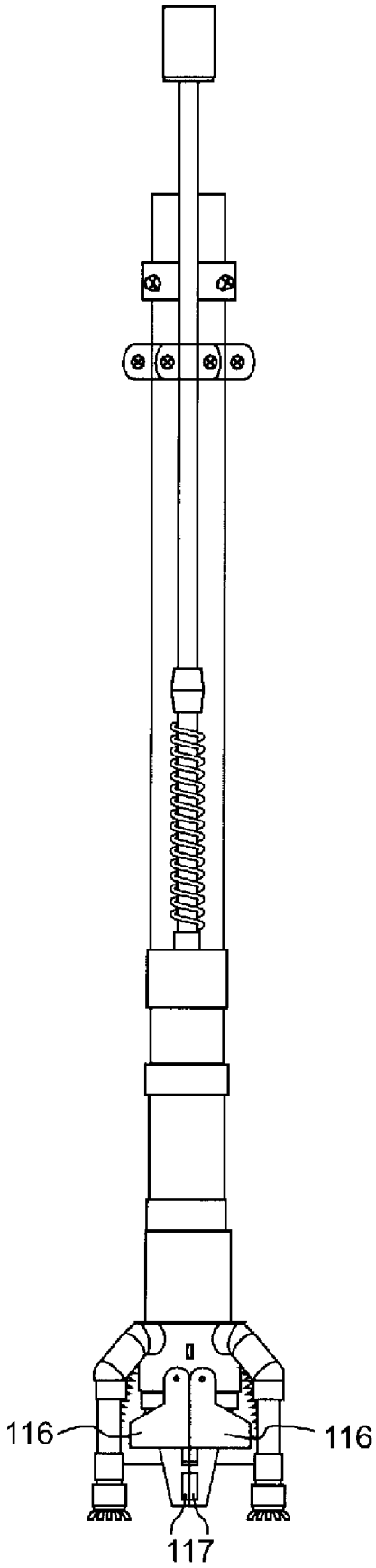
FIG. 2 is a side elevational view of the first embodiment.

FIG. 1 is a front elevational view of a first embodiment of a teeing device 100. FIG. 2 is a side elevational view of the device 100. Referring to FIGS. 1 and 2, the teeing device 100 comprises a ball magazine 10, an actuator 40, a tee and ball release mechanism 60, a common passage 90, and a base 110.

The ball magazine 10 includes an elongate tube 12 that houses a plurality of golf balls B. The top of the tube 12 is open and balls B can be inserted into the tube 12 in the direction of the arrow A. A height adjustment mechanism 14 is disposed at a top portion of the elongate tube 12, and functions to set the height of a tee T. The height adjustment mechanism 14 includes an adjustment handle 16 for engaging and disengaging the height adjustment mechanism 14. The height adjustment mechanism 14 is discussed in detail below with reference to FIG. 3. A bag hanger 20 can be mounted on the side of the device 100 and can be used to attach the device 100 to a golf bag.

The actuator 40 includes a tee magazine 50 having a hollow rod 42 that houses a plurality of tees T. An actuator handle 44 at the top of the hollow rod 42 is open such that tees T can be dropped into the hollow rod 42 in the direction of arrow C. The interior cross section of the actuator handle 44 may have a hollow cylindrical shape that conforms to the shape of a beverage can, so that a can can be held by the device 100 during use.

The actuator 40 is biased to a reset/load position, shown in FIG. 1, by a spring 46. The spring 46 acts against a collar or coupling 48 that is secured to the hollow rod 42, and against the top of the common passage 90. The hollow rod 42 terminates at a set coupling 54 at its lower end. A clamp 56 is fixedly attached to the tee magazine 50 by a threaded rod 52 and acts in conjunction with the height adjustment mechanism 14 to set the height of the actuator 40 and therefore the tee height. The clamp 56 may be, for example, a split ring hanger.

A tee and ball release mechanism 60 is actuated by downward movement of a release handle 61. Actuation of the tee and ball release mechanism 60 releases a tee T and a ball B into the common passage 90 for setting in the ground. The tee and ball release mechanism 60 is discussed in detail below with reference to FIG. 6.

The base 110 includes a plurality of legs 112 that support the mechanism 100 in an upright position. Two jaws 116 (shown in FIG. 2) are capable of pivoting outwardly to allow a ball B and a tee T to pass through the base 110 and for the tee T to be forced into the ground with the ball B set on top of the tee T. One or more wheels 120 can be attached to the legs 112 to allow rolling of the device 100. The base 110 is discussed in detail below with reference to FIGS. 4 and 5. Magnets 117 can be mounted on the jaws 116 to hold the jaws 116 in a closed position.

Figure 3:
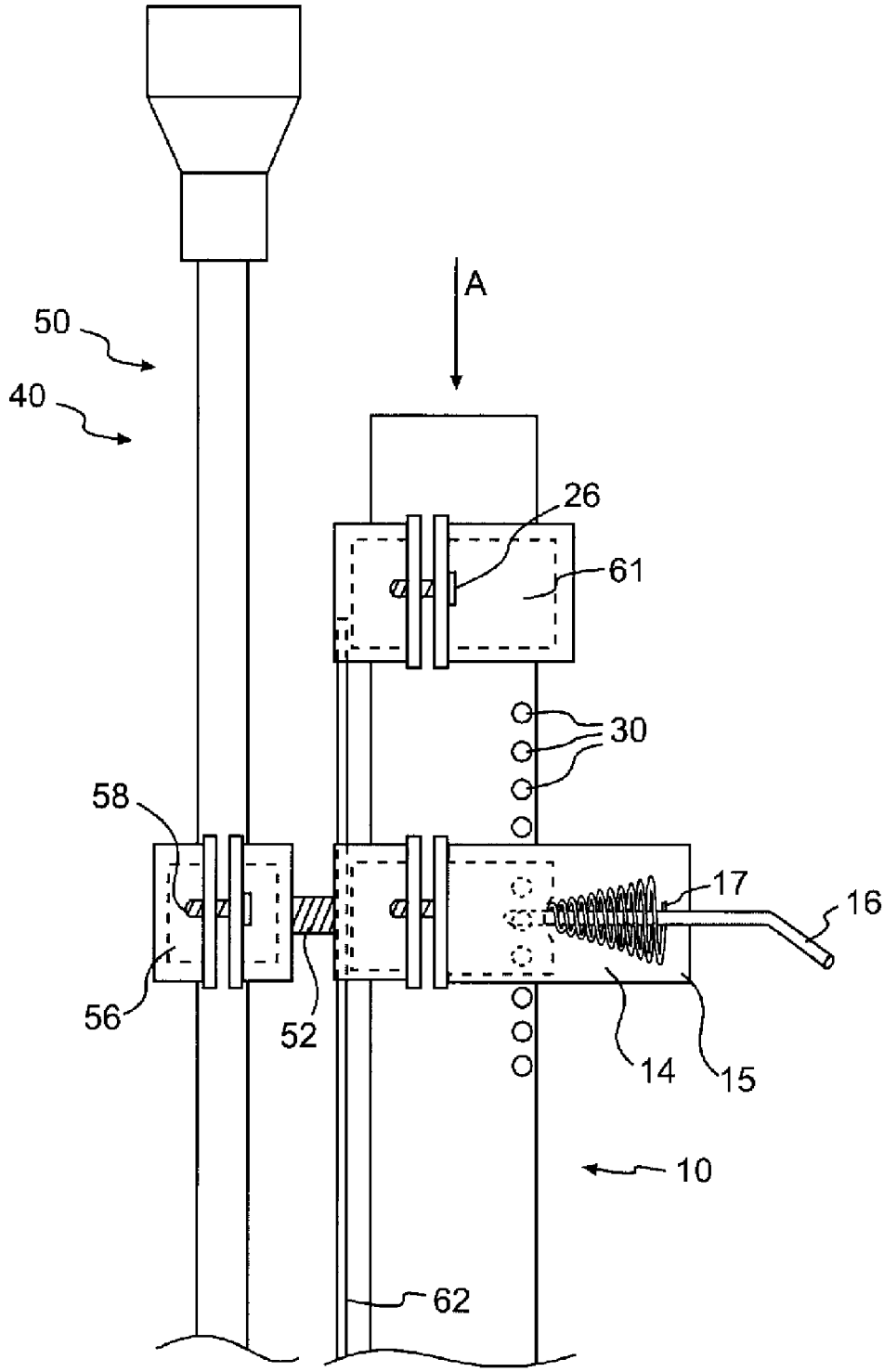
FIG. 3 is detailed front elevational view of a height adjustment mechanism.

FIG. 3 is a detailed front elevational view of the height adjustment mechanism 14. Referring to FIG. 3 and to FIG. 1, the height adjustment mechanism 14 includes a clamp 15 coupled to the clamp 56 by the threaded rod 52. The clamp 15 may be, for example, a split ring hanger. The clamp 15 can include a plastic sleeve (shown by hidden lines in FIG. 3) mounted therein that is sized to slide freely up and down over the ball magazine 10. The adjustment handle 16 is slidably mounted in the clamp 15 and can engage adjustment holes 30 in the ball magazine 10. Each hole 30 represents a different tee height achieved by the device 100. Tee height is adjusted by pulling the adjustment handle 16 outwardly, against the bias of a spring 17, so that the adjustment handle disengages a hole 30. The clamp 15 is slidable on the ball magazine 10 when the adjustment handle 16 is disengaged, and the user can therefore slide the clamp 15 either up or down and allow the adjustment handle 16 to engage any desired hole 30.

Referring to FIG. 1, the clamp 15 is coupled to the clamp 56 by the rod 52. Movement of the clamp 15 therefore results in vertical translation of the tee magazine 50. The vertical position of the set coupling 54 inside the tee magazine 50, at both the reset/load and the tee setting positions, is therefore adjusted by vertical movement of the height adjustment mechanism 14.

A release rod 62 of the tee and ball adjustment mechanism 60 extends through a hole in the clamp 15 and is fixedly mounted to the release handle 61. The rod 62 slides within the hole, allowing vertical translation of the release rod 62. Passing the release rod 62 through the hole in the clamp 15 adds stability to the release rod 62.

Figure 4:
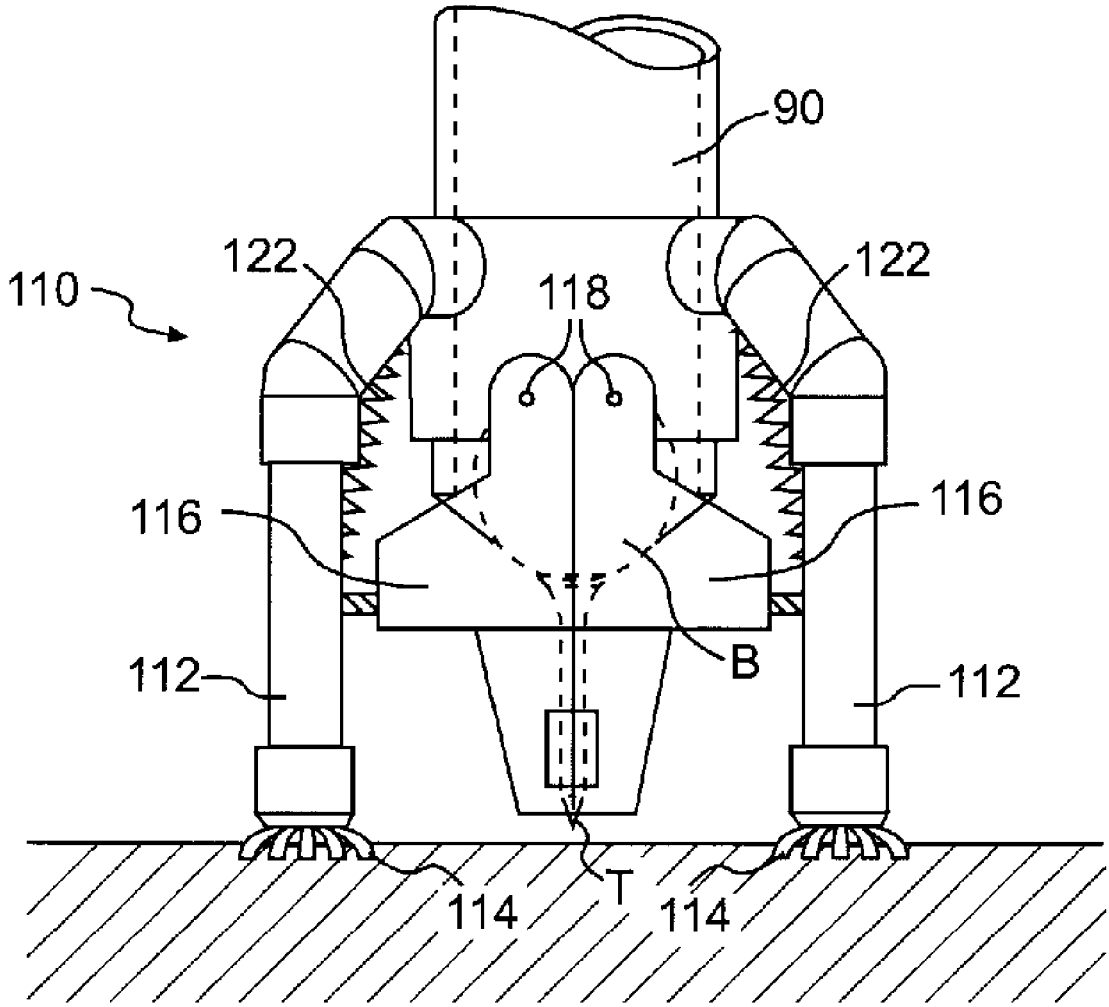
FIG. 4 is a detailed side elevational view of a base of the teeing mechanism prior to setting a tee.
Figure 5:
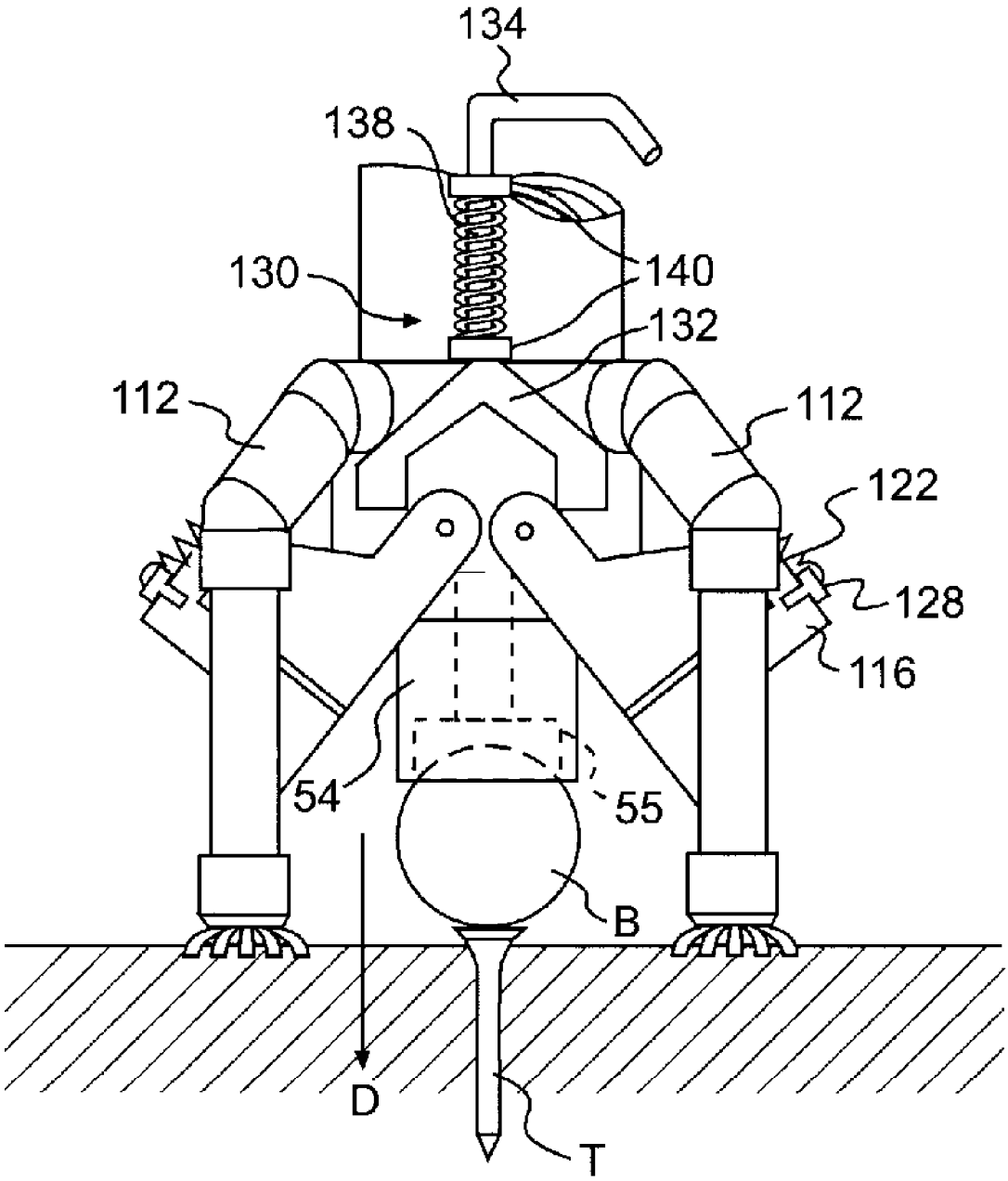
FIG. 5 is a detailed side elevational view of the base of the teeing mechanism during setting of a tee.

FIGS. 4 and 5 are detailed side elevational views of the base 110 during tee setting. FIG. 4 illustrates a side of the base as seen from the right side of FIG. 1, before a tee T and ball B are set in the ground. FIG. 5 illustrates the opposite side of the base 110 as seen from the left side of FIG. 1, shown in a position after setting of the tee T and ball B.

Referring to FIGS. 4 and 5, a tee T is held in a cavity within the jaws 116. Springs 122 are in tension and bias the jaws 116 to the open position shown in FIG. 5. A closure mechanism 130 (FIG. 5) and the magnets 117 hold the jaws 116 closed. The ball B held is above the tee T and rests on inner portions of the jaws 116. Spikes 114, which can be conventional golf spikes, can be mounted to the bottom of the legs 112 to add stability to the device 100. Referring to FIG. 5, the set coupling 54 has forced open the jaws 116, and pushed the tee T into the ground. The setting height shown in FIG. 5 is illustrated as a low tee height, such as is used for hitting irons. The tee T can be set at any desirable height, however. Adjustment of the height adjustment mechanism 14 (shown in FIGS. 1 and 3) controls the height of the tee T. When the tee T and ball B are set, the user steps on a foot pedal reset 134, which depresses a spring 138 and causes a closure bracket 132 to close the jaws 116. Eyelets 140 hold the spring 138 in place.

Figure 6:
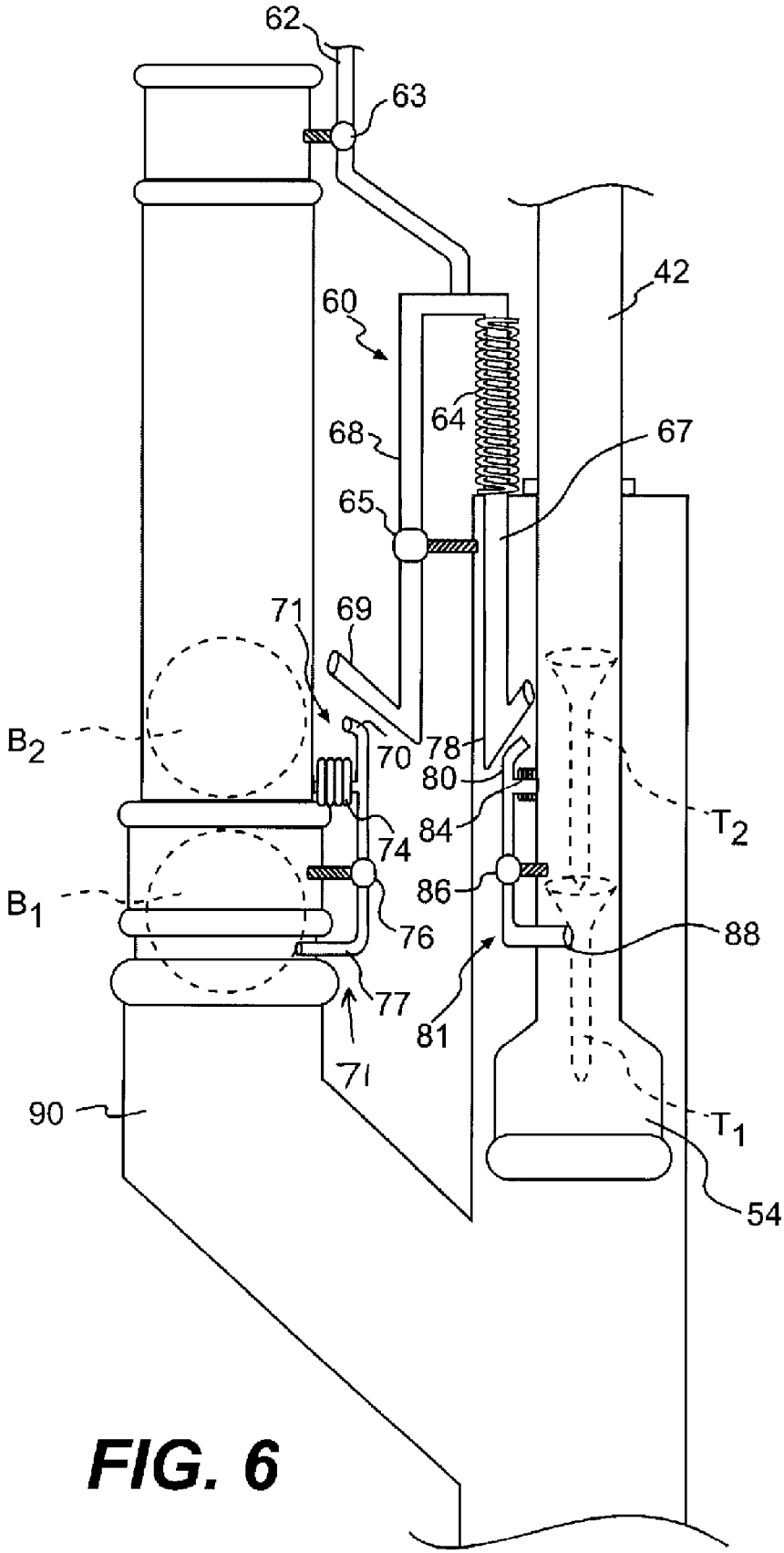
FIG. 6 is a detailed front elevational view of a tee and ball release mechanism in a reset/load position.
Figure 7:
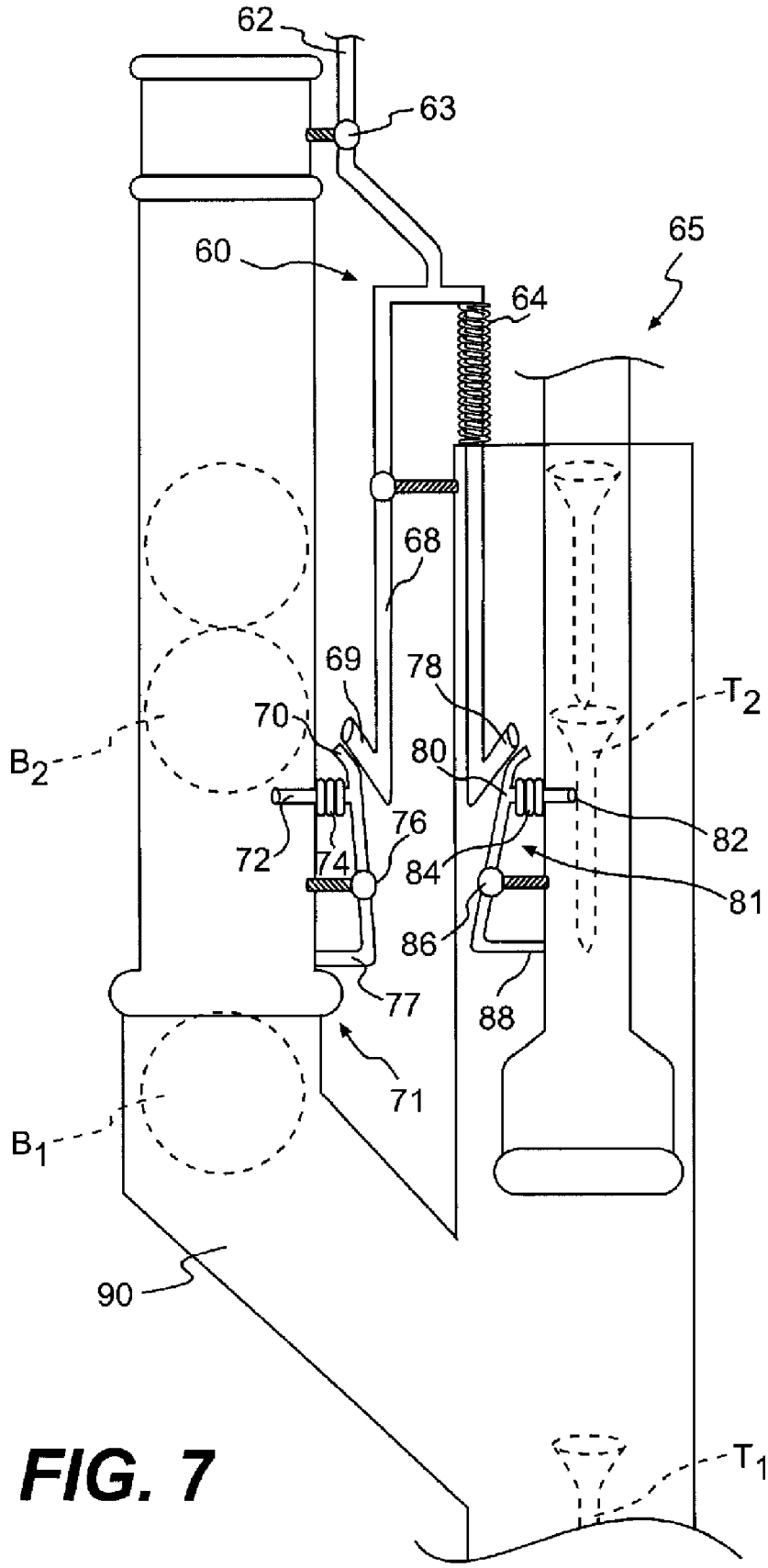
FIG. 7 is a detailed front elevational view of the tee and ball release mechanism during release of a tee and ball.

FIGS. 6 and 7 are detailed front elevational views of the tee and ball release mechanism 60. FIG. 6 shows the mechanism 60 in the reset/load position. FIG. 7 shows the release mechanism 60 at a point at which a tee $T_1$ has been released and a ball $B_1$ is in the process of being released.

Referring to FIG. 6, the release rod 62 terminates at a tee release leg 67 and a ball release leg 68. At a point above the legs 67, 68, the rod 62 can be slidably mounted in an eyelet 63 to add stability to the rod 62. The ball release leg 68 can also be slidably mounted in an eyelet 65. The ball release leg 68 terminates at an abutment portion 69 that engages an abutment portion 70 of a ball release 71. The ball release 71 is mounted in an eyelet 76 so that it is pivotable to some degree in the eyelet 76. A spring 74 biases the ball release 71 such that a ball stop 77 extends through a hole in the common passage 90 and holds the ball $B_1$ in place. The tee release leg 67 terminates at an abutment portion 78 that engages an abutment portion 80 of a tee release 81. The tee release 81 is mounted in an eyelet 86 so that it is pivotable in the eyelet 86. A spring 84 biases the tee release 81 such that a tee stop 88 extends through a hole in the hollow rod 42 and holds the tee $T_1$ in place.

Referring to FIGS. 1 and 7, when the release handle 61 is moved downward by a user, the rod 62 moves downward, along with the legs 67, 68. The tee release leg 67 is arranged to engage the abutment portion 80 of the tee release 81 and to withdraw the tee stop 88 from the hollow rod 42. The tee stop 88 withdraws from contact with the tee $T_1$ and allows the $T_1$ to drop. An interim tee stop 82 is simultaneously pushed into the hollow rod 42 to prevent a second tee $T_2$ from dropping into the common passage 90. Shortly after release of the tee $T_1$, the abutment portion 69 of the ball release leg 68 abuts the abutment portion 70 as the release rod 62 continues downward, withdrawing the ball stop 77 from the ball magazine 10 and allowing the ball $B_1$ to drop. An interim ball stop 72 is simultaneously pushed into the ball magazine 10 to prevent a second ball $B_2$ from dropping into the common passage 90.

When the release handle 61 is released, the spring 64 pushes the release rod 62 upward and disengages the legs 67, 68 from the tee release 81 and ball release 71, respectively. The releases 71, 81, then pivot back to the positions shown in FIG. 6.

Figure 8A:
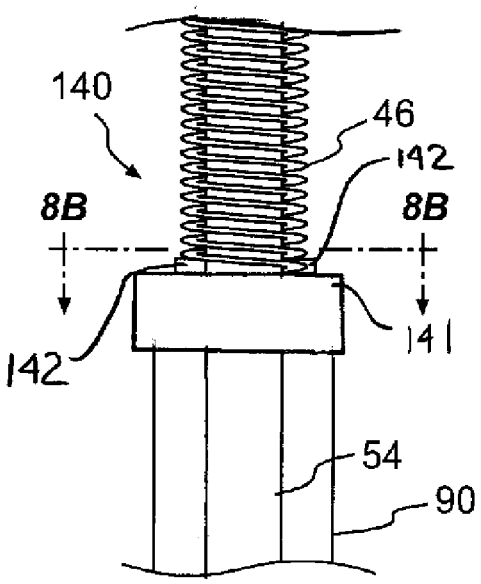
FIG. 8A is a detailed elevational view of a set coupling locking mechanism.
Figure 8B:
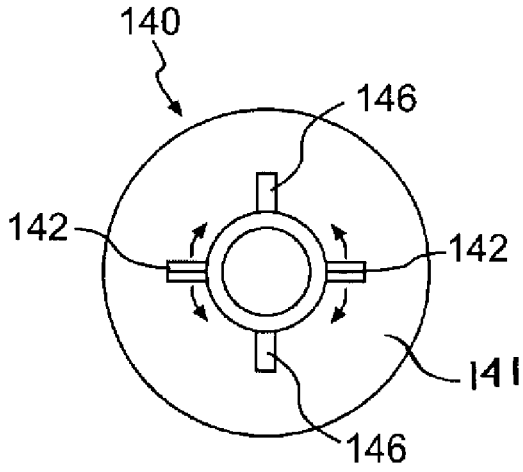
FIG. 8B is a section view taken on line 8B—8B in FIG. 8A.

FIG. 8A is a detailed elevational view of a locking mechanism 140 for the set coupling 54. FIG. 8B is a section view taken on line 8B—8B in FIG. 8A. Referring also to FIG. 1, the tee magazine 50 is rotatable within the upper part of the common passage 90. The locking mechanism 140 comprises a cap 141 mounted on the common passage 90, two locking keys 142 extending outwardly from elongate tube 42 of the actuator 40. The top of the common passage includes two slots 146 for receiving the locking keys 142. When the device 100 is not in use, the tee magazine 50 can be pulled upward and rotated so that the locking keys 142 exit the slots 146, thereby leaving the interior of the cap 141. When the actuator 40 is rotated, the keys 142 no longer align with the slots 146 and the actuator 40 cannot move downward. In this position, the tee magazine 50 is cannot be moved downward to set a tee T. To use the device 100, the tee magazine 50 can be rotated so that the keys 142 once enter the slots 146.

Operation of the device is described below with reference to FIGS. 1–7. Referring to FIGS. 1 and 3, a user first sets the tee height to a desired height by pulling the adjustment handle 16 outward from the clamp 1 5, and sliding the clamp 15 either upward or downward depending on the desired tee height. The tee and ball release mechanism 60 is now in the position shown in FIG. 6, and the base 110 is in the position shown in FIG. 1, without a ball B or T held therein.

Referring to FIGS. 1 and 7, the user then pushes the release handle 61 downward, allowing a tee $T_1$ and a ball $B_1$ to drop as shown in FIG. 7. After dropping through the common passage 90, the ball $B_1$ and tee $T_1$ assume the positions in the base 110 shown in FIG. 4. The release handle 61 is allowed to return to its reset/load position under the bias of the spring 64 (shown in FIG. 6). The ball release 71 and the tee release 81 return to the positions shown in FIG. 6 as the release rod 62 disengages with the releases 71, 81. At this time, the tee $T_2$ held by the interim stop 82 drops until it engages the tee stop 88. The ball $B_2$ held by the interim stop 72 drops until it engages the ball stop 77.

Referring to FIGS. 1 and 5, after the ball $B_1$ and tee $T_1$ have dropped into the base 110, the actuator 40 is pressed downward against the bias of the spring 46. The set coupling 54 at the end of the actuator 40 translates downward until it acts on the ball B and forces the tee T into the ground. When pressure on the actuator 40 is released, the user steps on the closure mechanism 130 can closes the jaws 116. The magnets assist 117 in holding the jaws 116 closed.

The ball magazine 10 and the common passage 90 can be made from, for example, PVC tubing joined by couplings, where required. The tube 42 can be, for example, a PVC tube. The base 110 can also be constructed from PVC tubing and couplings. The jaws 116 can be made from molded plastics material such as PVC. Other plastic materials, or metals may also be used to form the device 100.

The foregoing description of the invention illustrates and describes the present invention. Additionally, the disclosure shows and describes only selected preferred embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments, not explicitly defined in the detailed description.

The invention claimed is:

1. A teeing device, comprising:

a ball magazine;

an actuator having a tee magazine to receive tees with distal tee ends directed therein for placing in the ground;

a common passage connecting the ball magazine and the tee magazine, wherein the common passage extends below the tee magazine; and a base connected to the common passage, wherein the base comprises pivotable opposed jaws and legs for supporting the device, wherein the jaws are selectively operable to allow a tee and ball to pass through the bottom of the base for setting, and wherein the base receives tees and balls from the common passage and allows the actuator to place a tee in the ground with a ball set thereon.

2. The teeing device of claim 1, comprising:

a tee and ball release mechanism disposed to release tees from the tee magazine.

3. The teeing device of claim 1, comprising:

a height adjustment mechanism coupled to the ball magazine and the actuator, wherein the height adjustment mechanism is arranged to adjust the height of the tee magazine.

4. The teeing device of claim 1, wherein the ball magazine comprises an elongate tube sized to receive golf balls.

5. The teeing device of claim 1, wherein the actuator comprises:

a set coupling mounted at an end of the tube.

6. The teeing device of claim 2, wherein the tee and ball release mechanism comprises:

a tee release mounted adjacent to the tee magazine;

a ball release mounted adjacent to the ball magazine; and a release rod arranged to actuate both the tee release and ball release.

7. A teeing device, comprising:

a ball magazine;

an actuator having a tee magazine wherein the tee magazine has a tube that is slidably received within a portion of the common passage, and is biased to a reset/load position by a spring;

a common passage connecting the ball magazine and the tee magazine, wherein the common passage extends below the tee magazine; and a base connected to the common passage, wherein the base receives tees and balls from the common passage and allows the actuator to place a tee in the ground with a ball set thereon.

8. The teeing device of claim 7, wherein the actuator comprises:

a set coupling mounted at an end of the tube.

9. The teeing device of claim 7, comprising:

a height adjustment mechanism coupled to the ball magazine and the actuator, wherein the height adjustment mechanism is arranged to adjust the height of the tee magazine.

10. The teeing device of claim 7, wherein the base comprises:

pivotable opposed jaws, wherein the jaws are selectively operable to allow a tee and ball to pass through the bottom of the base for setting.

11. The teeing device of claim 7, wherein the ball magazine comprises an elongate tube sized to receive golf balls.

12. The teeing device of claim 7, further comprising a tee release mounted adjacent to the tee magazine;

a ball release mounted adjacent to the ball magazine; and a release rod arranged to actuate both the tee release and ball release.

13. The teeing device of claim 7, comprising:

a tee and ball release mechanism disposed to release tees from the tee magazine.

* * * * *